US010508526B2

(12) United States Patent
Ring et al.

(10) Patent No.: US 10,508,526 B2
(45) Date of Patent: Dec. 17, 2019

(54) FRACING PLUG

(71) Applicant: Schlumberger Technology Corporation, Sugar Land, TX (US)

(72) Inventors: Curtis Ring, Calgary (CA); Grant George, Calgary (CA); Matthew McCarthy, Calgary (CA); Shane Sargent, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/579,918

(22) PCT Filed: May 5, 2017

(86) PCT No.: PCT/CA2017/050555
§ 371 (c)(1),
(2) Date: Dec. 5, 2017

(87) PCT Pub. No.: WO2017/190255
PCT Pub. Date: Nov. 9, 2017

(65) Prior Publication Data

US 2019/0048698 A1 Feb. 14, 2019

Related U.S. Application Data

(60) Provisional application No. 62/332,948, filed on May 6, 2016.

(51) Int. Cl.
*E21B 43/26* (2006.01)
*E21B 33/12* (2006.01)
(Continued)

(52) U.S. Cl.
CPC ..... *E21B 43/26* (2013.01); *E21B 33/1208* (2013.01); *E21B 33/134* (2013.01); *E21B 34/063* (2013.01)

(58) Field of Classification Search
CPC .... E21B 33/1208; E21B 33/134; E21B 33/12; E21B 33/129; E21B 33/1291;
(Continued)

(56) References Cited

U.S. PATENT DOCUMENTS 1,476,727 A 12/1923 Quigg
2,230,712 A 2/1941 Bendeler et al.
(Continued)

OTHER PUBLICATIONS

International Searching Authority, The International Search Report and the Written Opinion of the International Searching Authority, or the Declaration, International Application No. PCT/CA2017/050555, Filed May 5, 2017, 3 pages, Receiving Office—Canadian Intellectual Property Office.

*Primary Examiner* — George S Gray
(74) *Attorney, Agent, or Firm* — Kelly McKinney

(57) ABSTRACT

An apparatus for use in forming a plug during hydraulic fracturing of a subterranean soil formation comprising a top tubular retaining body extending between top and bottom ends and having a frustoconical outer surface extending from the bottom end thereof. The apparatus further includes a plurality of slip arms located around the outer surface of the retaining body, each slip arm extending between top and bottom ends and having an inner surface extending from the top end corresponding to the outer surface of the retaining body and an exterior surface adapted to frictionally engage a wellbore; and a seal element located around the outer surface of the retaining body above the plurality of slip arms adapted to be displaced towards the top end of the retaining body by the plurality of slip arms so as to seal an annulus between the retaining body and the wellbore.

25 Claims, 19 Drawing Sheets

(51) Int. Cl.
*E21B 33/134* (2006.01)
*E21B 34/06* (2006.01)

(58) Field of Classification Search
CPC ..... E21B 33/1293; E21B 33/128; E21B 33/2304; E21B 34/063; E21B 23/01; E21B 23/06; E21B 43/26
See application file for complete search history.

(56) References Cited

U.S. PATENT DOCUMENTS

| | | | | |
|---|---|---|---|---|
| 4,901,794 | A | 2/1990 | Baugh et al. | |
| 6,443,458 | B1 | 9/2002 | Jansch | |
| 8,839,855 | B1 | 9/2014 | McClinton et al. | |
| 2010/0276159 | A1* | 11/2010 | Mailand | E21B 33/129 166/382 |
| 2013/0140042 | A1 | 6/2013 | Benson et al. | |
| 2016/0186511 | A1* | 6/2016 | Coronado | E21B 33/128 166/381 |
| 2017/0130553 | A1* | 5/2017 | Harris | E21B 23/01 |

* cited by examiner

FRACING PLUG

BACKGROUND OF THE INVENTION

1. Field of Invention

The present invention relates to hydrocarbon production in general and in particular to a method and apparatus for locating a fracturing plug within a well.

2. Description of Related Art

In the field of hydrocarbon production, hydraulic fracturing or "fracing" is a process of stimulating a hydrocarbon producing well by fracturing the surrounding rock with a hydraulically pressurized fluid of water, sand and chemicals. During fracing it is commonly necessary to isolate each zone so as to only provide the pressurized fluid and sand to the desired location within the well. This is due to the potential for the well to be quite long and therefore the pumping and material required to therefore frac the entire well string would be too large.

One common method of splitting the well up into the manageable zones is to provide a plug below the zone to be fraced and thereafter perforating the well bore liner in that zone with an explosive or the like. Thereafter the pressurized fluid and sand may be pumped to that location to perform the frac. This process may be repeated in successive steps upward from the bottom of the well to successively frac each zone that is desired. One conventional type of plug is a ring or seat which may be engaged upon the interior of the well bore. Thereafter a ball may be dropped to be engaged upon the seat so as to seal the wellbore.

Current difficulties with conventional seats are the complicated number of components which are utilized to both engage the interior of the wellbore and seal the seat thereto. Additionally, common conventional seats also have a limited pressure which they can withstand due to the limited grip such seats have upon the wellbore wall. Furthermore, conventional seats are commonly required to be milled out of the wellbore after completing the fracing process due the restriction of the wellbore through the seat.

SUMMARY OF THE INVENTION

According to a first embodiment of the present invention there is disclosed an apparatus for use in forming a plug during hydraulic fracturing of a subterranean soil formation comprising a top tubular retaining body extending between top and bottom ends and having a frustoconical outer surface extending from the bottom end thereof. The apparatus further includes a plurality of slip arms located around the outer surface of the retaining body, each slip arm extending between top and bottom ends and having an inner surface extending from the top end corresponding to the outer surface of the retaining body and an exterior surface adapted to frictionally engage a wellbore; and a seal element located around the outer surface of the retaining body above the plurality of slip arms adapted to be displaced towards the top end of the retaining body by the plurality of slip arms so as to seal an annulus between the retaining body and the wellbore.

The outer surface of the retaining body may be formed of a plurality of alternating angled and horizontal sections. The inner surface of the plurality of slip arms may include a plurality of alternating angled and horizontal sections adapted to correspond to the outer surface of the retaining body.

The retaining body may include a central bore therethrough. The central bore may form a ball seat adapted to retain a ball thereon.

The central bore may include a slidably movable plug therethrough. The slidably movable plug may engage upon the plurality of slip arms to draw the plurality of slip arms onto the outer surface of the retaining body. The slidably movable plug may include a bottom expanded portion having a larger diameter than the plurality of slip arms. The slidably movable plug may include a top plug adapted to be spaced apart from a seat in the retaining body as the plurality of slip arms are drawn over the retaining body. The slidably movable plug may be operable to slidably shift up and down so as to seal and unseal the top plug against the seat so as to permit fluid flow up the wellbore and prevent fluid flow therepast down the wellbore.

The plurality of slip arms may extend from a ring surrounding the retaining body adjacent to the seal element. The plurality of slip arms may include tabs extending from the bottom end thereof in a direction substantially parallel to a central axis of the retaining body. The tabs may include bores adapted to pass a fastener therethrough for securing to a setting tool within the retaining body.

The apparatus may further comprise a selectably expandable ring surrounding the plurality of slip arms so as to retain the plurality of slip arms at a retracted position until expanded by a setting tool. The selectably expandable ring may include a gap therethrough so as to permit radial expansion of the selectably expandable ring. The selectably expandable ring may include a frangible portion so as to permit radial expansion of the selectably expandable ring. The selectably expandable ring may include a narrowed portion so as to permit radial expansion of the selectably expandable ring after breaking the narrowed portion.

The plurality of slip arms may be formed of a selectably dissolvable material. The plurality of slip arms may be formed of a material selected from the group consisting of steel and aluminum alloys. The plurality of slip arms may include well bore engaging plugs imbedded therein.

The apparatus may further comprise a setting tool adapted to pass through the central bore of the retaining body. The setting tool may comprise an exterior portion adapted to bear upon a top edge of the retaining body and an interior portion adapted to engage upon a bottom edge of the plurality of slip arms so as to draw the plurality of slip arms towards the retaining portion. The interior portion may include pull arms adapted to engage the bottom edge of the plurality of slip arms. The pull arms may include an inclined surface adapted to engage a corresponding inclined surface of the plurality of slip arms. The pull arms may be longitudinally cantilevered parallel to the axis of the retaining body. The interior portion of the setting tool may include a transfer sleeve therearound having a portion adapted to engage upon distal ends of the pull arms to retain the pull arms at a radially expanded position so as to engage upon the plurality of slip arms. The transfer sleeve may be secured to the interior portion with a frangible connector wherein after the frangible connector is broken, the transfer sleeve is operable to be shifted downward thereby permitting the pull arms to be moved radially inward so as to permit removal of the setting tool.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
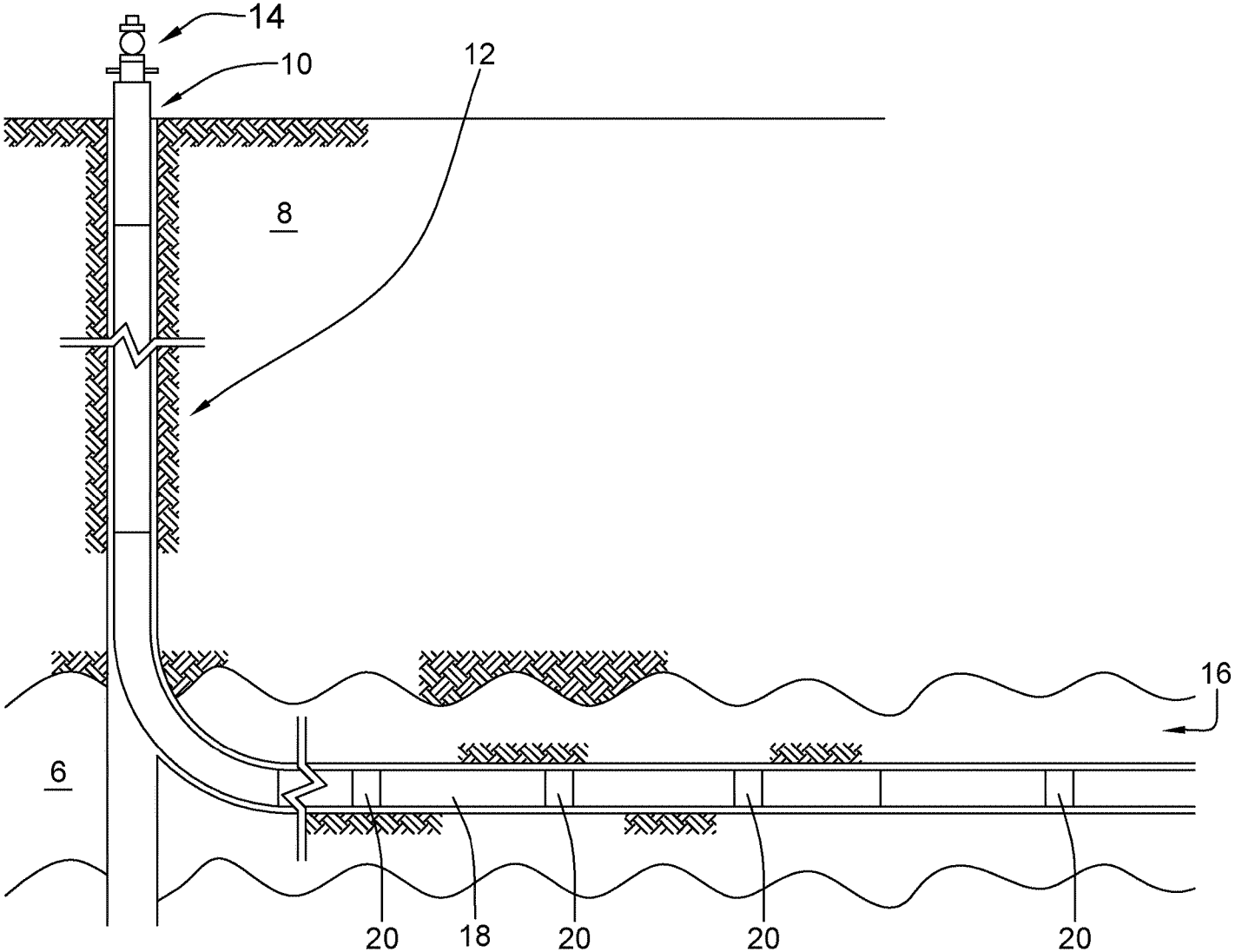
FIG. 1 is a cross sectional view of a well bore having a plurality of plugs located therein associated with each zone to be utilized for sealing and hydraulically fracturing each zone.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a wellhead valve assembly or Christmas tree 14 at a top end thereof and a bottom or production section 16 which may be horizontal, vertically or angularly oriented relative to the horizontal located within the production zone 6. As illustrated in FIG. 1, the production section 16 is separated into one or more zones 18 with fracing plug seats 20 located therebetween for subsequent fracing.

Figure 2:
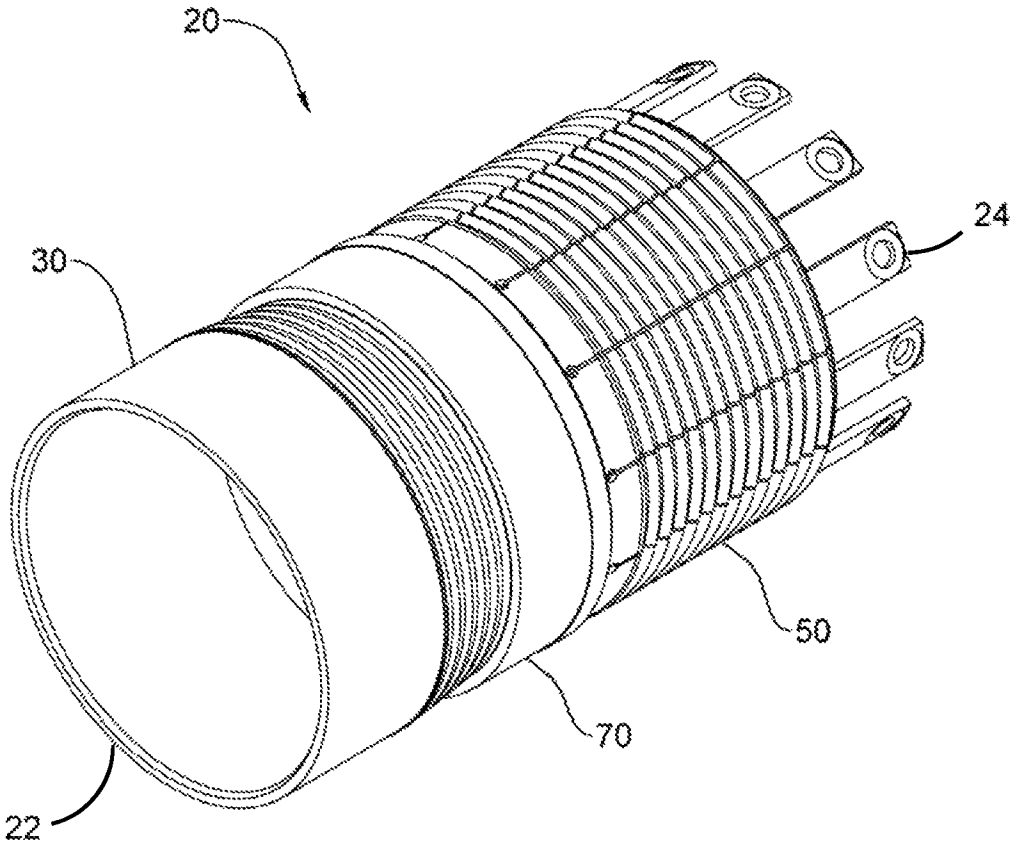
FIG. 2 is a perspective view of one of the plugs for use in the well bore of FIG. 1.

With reference to FIG. 2, a fracing plug seat according to a first embodiment of the present invention is illustrated generally at 20. The fracing plug seat 20 extends between first and second ends 22 and 24, respectively, and is formed of a top tubular retaining body 30 at the first end 22, a plurality of slip arms 50 around the retaining body 30 forming the second end 24 of the seat, and a seal 70 located therebetween.

Figure 8:
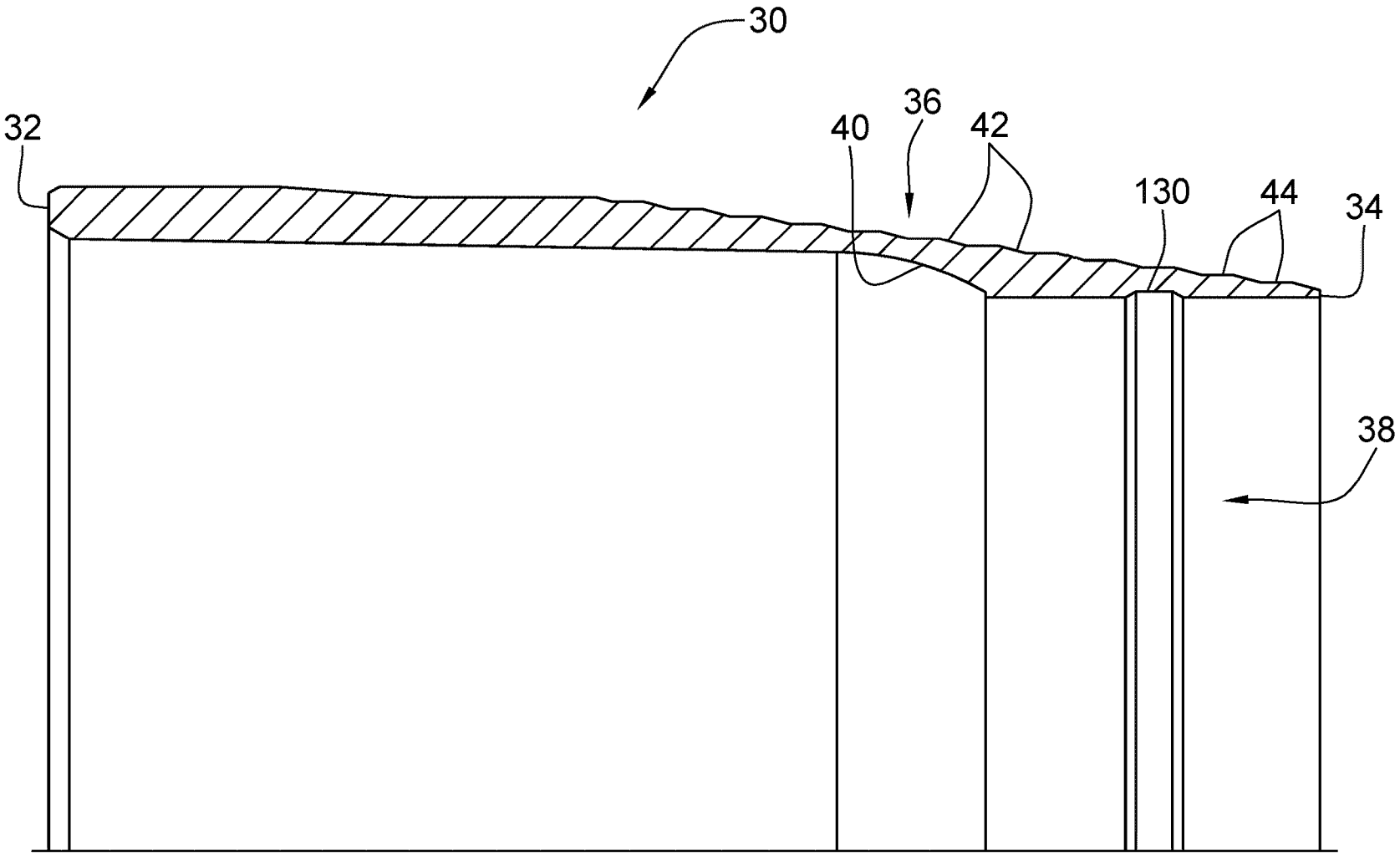
FIG. 8 is a cross sectional view of the cone of the plug of FIG. 2.
Figure 9:
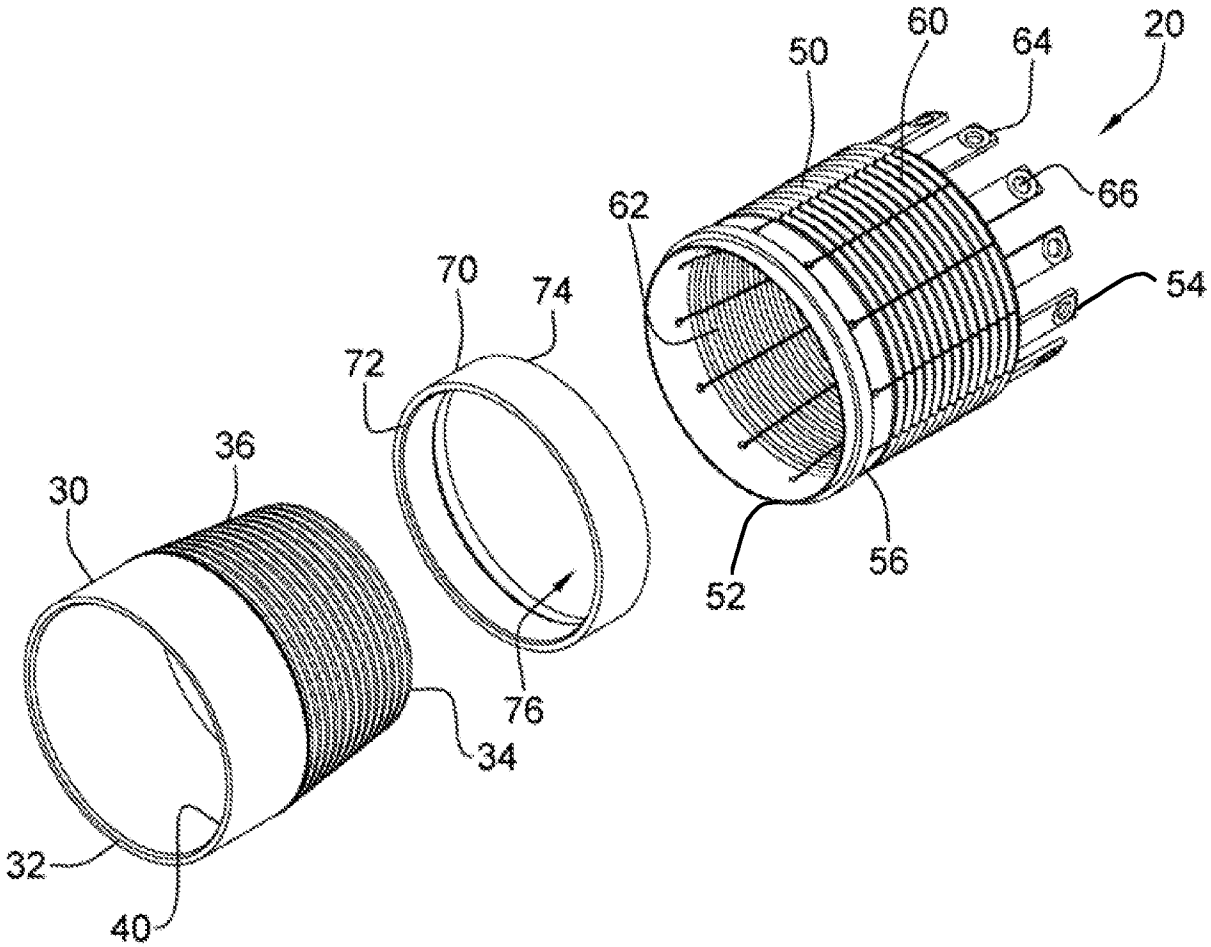
FIG. 9 is an exploded view of the plug of FIG. 2.

Turning now to FIG. 9 an exploded view of the fracing plug seat 20 is illustrated. The retaining body 30 comprises a tubular body extending between first and second ends 32 and 34, respectively. The retaining body 30 includes a cone section 36 extending from the second end 34 around the exterior surface thereof. The cone section 36 is adapted to engage with and displace the slip arms 50 outwardly as will be more fully described below. As illustrated in FIG. 8, the interior of the retaining body 30 includes a central passage 38 extending therethrough. The central passage is narrower proximate to the second end 34 than it is near the first end and includes a profiled section 40 adapted to receive a dropped ball (not shown) thereon as is commonly known.

Figure 7:
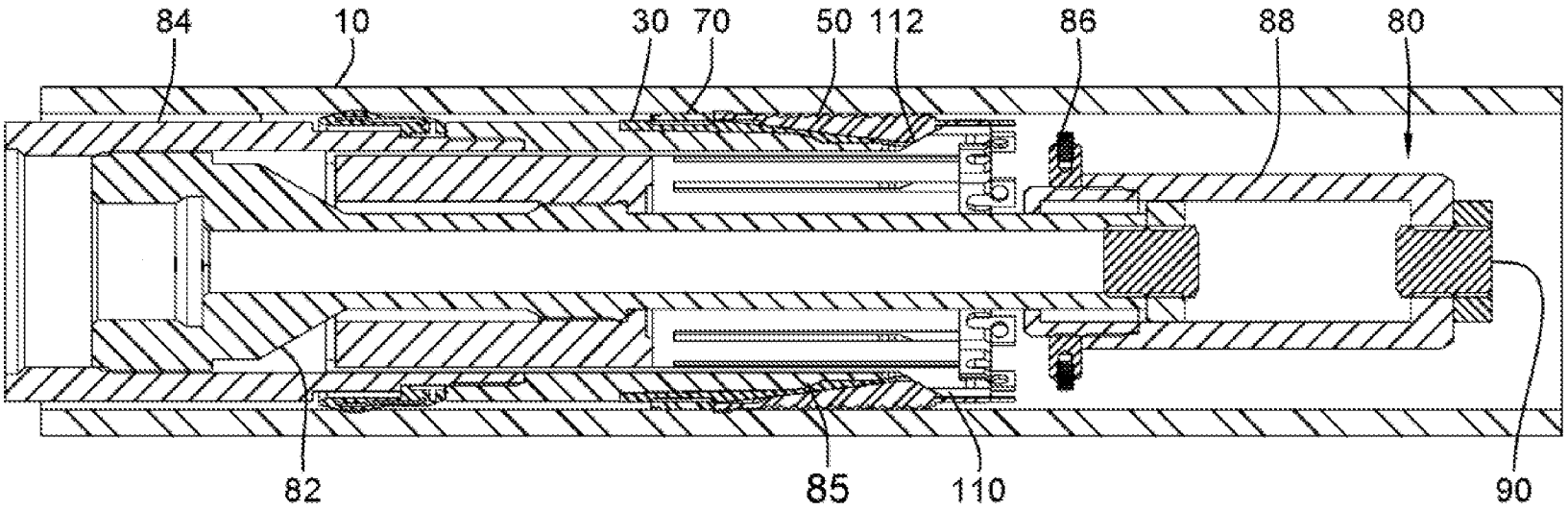
FIG. 7 is a cross sectional view of the plug and setting tool of FIG. 3 at a fourth or released position.

As illustrated in FIG. 8, the cone section 36 may be formed of alternating angled and horizontal portions 42 and 44, respectively. Alternatively, the cone section 36 may have a constant profile. The alternating angled and horizontal portions 42 and 44 assist with the engagement of the slip arms 50 upon the wellbore 10 by spreading the length of contact over a longer distance without reducing the angle movement of the slip arms 50 on the cone section 36. In particular, the horizontal portions 44 may be substantially aligned with the axis of the plug seat 20 wherein the angled portions may have a frustoconical shape having a slip angle generally indicated at 43 relative to the central axis of the plug seat 20. In practice, it has been found that a slip angle of between 5 and 30 degrees may be useful. Optionally, as illustrated in FIG. 8, the retaining body 30 may include an annular groove 130 in an interior surface thereof adapted to engage upon a ridge or other protrusion (not shown) extending from an outer portion extension 85 as illustrated in FIG. 7. Such annular groove 130 will be useful to prevent movement of the retaining body 30 during run in as will be further described below.

Turning back to FIGS. 2 and 9, the slip arms 50 are secured to a ring 56 at a first end 52 thereof. Each of the slip arms 50 extends to a second end 54 having a tab 64 with a bore 66 therethrough. The slip arms 50 include a well bore engaging surface 60 on an outer surface thereof and an inner cone engaging surface 62 on an interior thereof. The inner cone engaging surface 62 may be formed of alternating angled and horizontal portions sized and shaped to correspond to the cone section 36 as described above. The slip arms 50 and the ring 56 may be formed of any suitable materials as are commonly known. In particular, the ring 56 may be formed of a malleable material such as, by way of non-limiting example, cold steel so as to be deformable as the slip arms 50 are displaced over the retaining body 30.

The seal 70 comprises a ring member extending between first and second ends 72 and 74, respectively, having a central bore 76 therethrough. The central bore 76 is sized to be received around the cone section 36 of the retaining body 30 at a first or run in position. The seal 70 may be formed of any suitable material as is commonly known in the art such as, by way of non-limiting example, Viton™, nitrile, Polytetrafluoroethylene (PTFE), Polyetheretherketone (PEEK), Hydrogenated Nitrile Butadiene Rubber (HNBR), AFLAS®, or Kalrez®.

Figure 3:
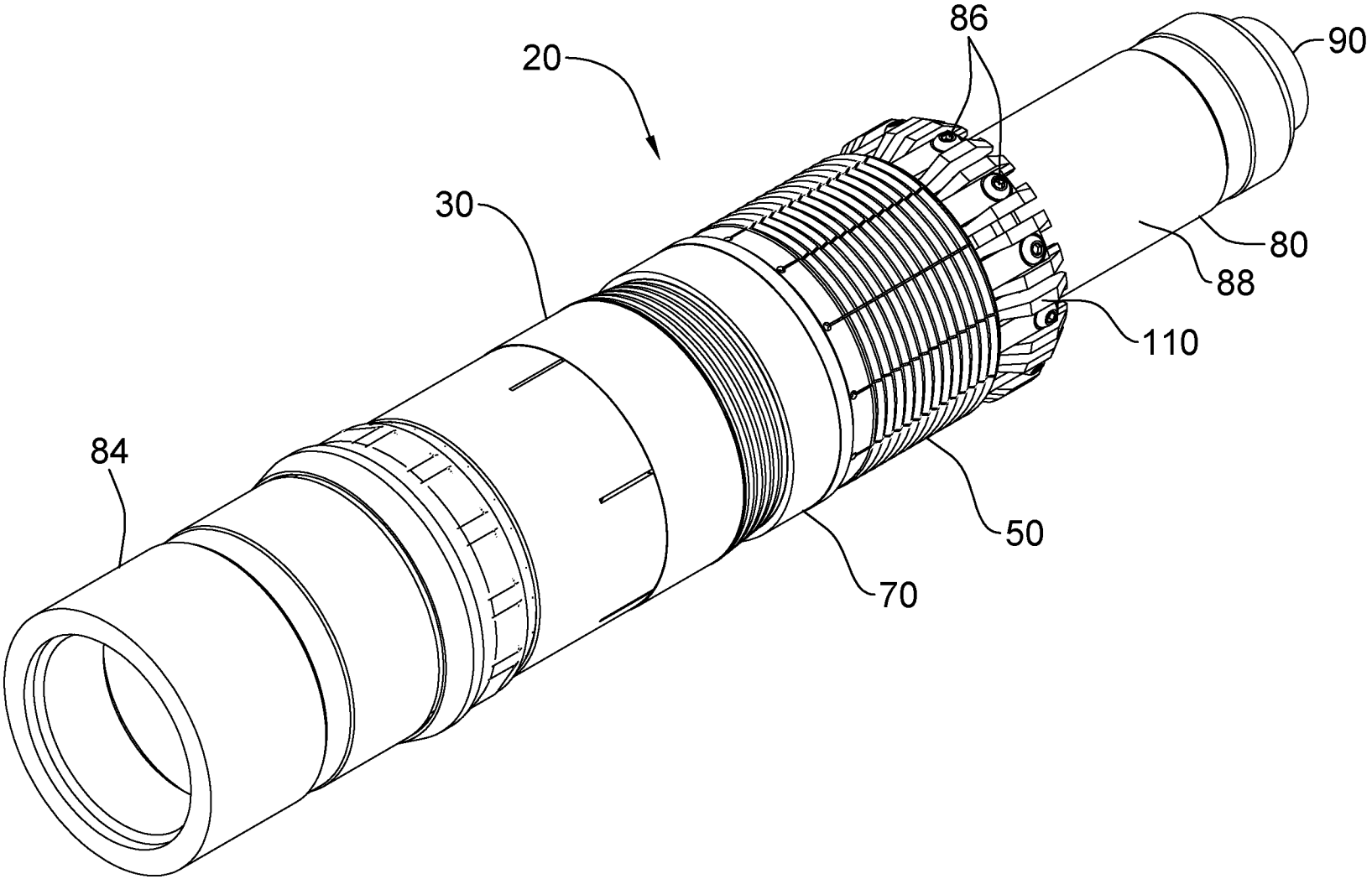
FIG. 3 is a perspective view of the plug of FIG. 1 with a setting tool located therein.

Turning now to FIG. 3, a setting tool 80 of any conventional type may be utilized having an outer portion 84 adapted to engage upon and press the retaining body 30 towards the second end 24 of the fracing plug seat 20 and an inner portion 82 adapted to engage the slip arms 50 and draw them towards the first end 22 of the fracing plug seat 20 so as to draw or slide the slip arms 50 and seal 70 over the cone section 36 thereby expanding them into contact with the wall of the well bore 10. In particular, as illustrated in FIGS. 4 through 7, the setting tool 80 includes a plurality of setting tool pull arms 110 extending threrealong at a position under the slip arms 50 of the fracing plug seat 20. The setting tool pull arms 110 include an inclined surface 112 in an orientation such that upward movement of the setting tool pull arms 110 will bias the slip arms 50 in an outward direction.

Figure 4:
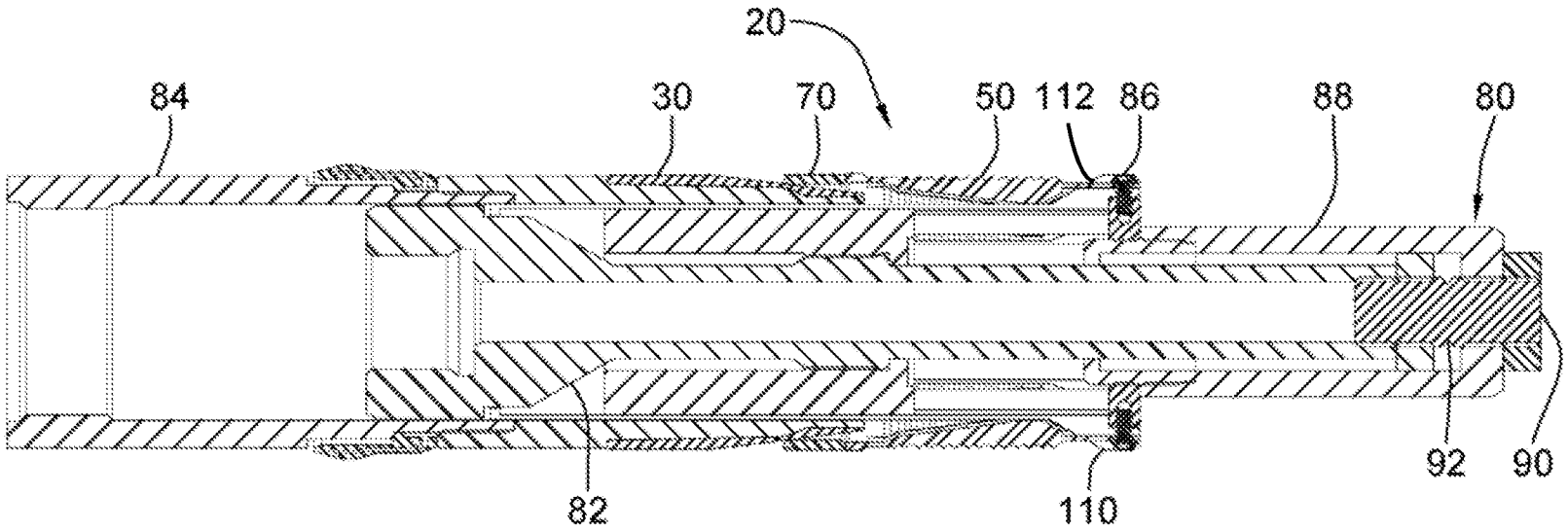
FIG. 4 is a cross sectional view of the plug and setting tool of FIG. 3 at a first or run in position.
Figure 5:
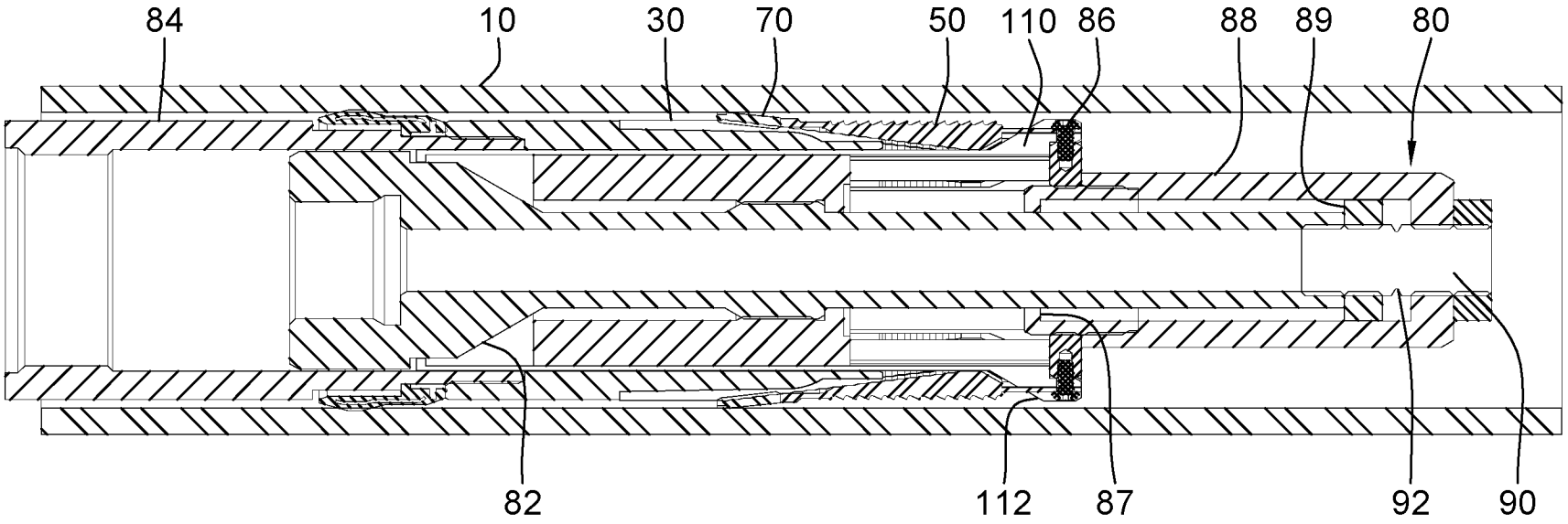
FIG. 5 is a cross sectional view of the plug and setting tool of FIG. 3 at a second or initial setting position.

As illustrated in FIGS. 3 and 4, the inner portion 82 of the setting tool 80 includes a transfer sleeve 88 secured thereto with an end plug 90. The end plug 90 includes a necked portion 92 adapted to be fractured so as to disengage the transfer sleeve 88 from the inner portion 82. As illustrated in FIG. 5, the transfer sleeve 88 further includes an annular ridge 87 extending inwardly at a top end thereof adapted to engage upon an outwardly extending annular ridge 89 at the distal end of the inner portion 82. The transfer sleeve 88 may be secured to the slip arms 50 with set pins 86 or other frangible fasteners as are commonly known being passed through the bores 66. As illustrated in FIG. 4, set pins 86 extend into the transfer sleeve 88 through the setting tool pull arms 110 and prevent the slip arms 50 from movement prior to breaking such that the transfer sleeve 88 is located thereunder preventing inward deflection of the setting tool pull arms 110.

Figure 6:
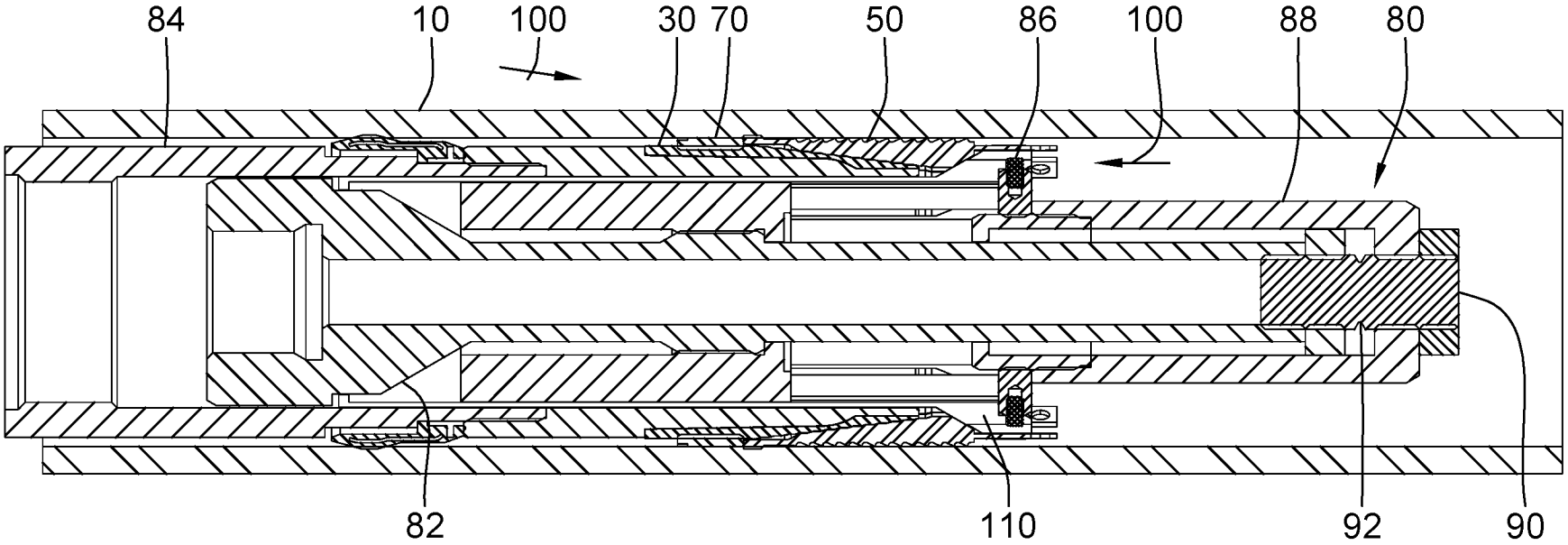
FIG. 6 is a cross sectional view of the plug and setting tool of FIG. 3 at a third or engaged position.

In operation, the fracing plug seat 20 and setting tool 80 may be secured to each other and run into the well bore 10 in the position shown in FIG. 4 with the slip arms 50 retracted and the seal 70 around the cone section 36 above the slip arms 50. Once located at the desired position, the inner portion 82 and outer portion 84 of the setting tool 80 may be drawn towards each other so as to move the retaining body 30 and the slip arms 50 towards each other in a direction generally indicated at 100 as illustrated in FIG. 6. Continued movement of the inner and outer portions 82 and 84 of the setting tool continue to press the seal 70 up the cone section 36 to be between the retaining body 30 and the well bore 10 as illustrated in FIG. 6 and to engage the slip arms 50 upon the well bore 10 as well as shear the set pins 86 thereby separating the transfer sleeve 88 and the setting tool pull arms 110 of the setting tool from the slip arms 50. Further pressure applied by the setting tool 80 will fracture the end plug 90 along at the necked portion 92 thereby separating the transfer sleeve 88 and the inner portion 82 of the setting tool 80 as illustrated in FIG. 7. At such point, the transfer sleeve 88 is permitted to shift downwardly on the inner portion 82 until the inner annular ridge 87 of the transfer sleeve 88 engages upon the outward annular ridge 89 on the inner portion 82 thereby preventing the transfer sleeve from slipping thereof. A user may then pull upwardly on both the inner and outer portions 82 and 84 to retract the setting tool 80 wherein the setting tool pull arms 110 are permitted to bias inwardly as the setting tool passes the slip arms 50 as there is no longer an object preventing such inward deflection.

Figure 14:
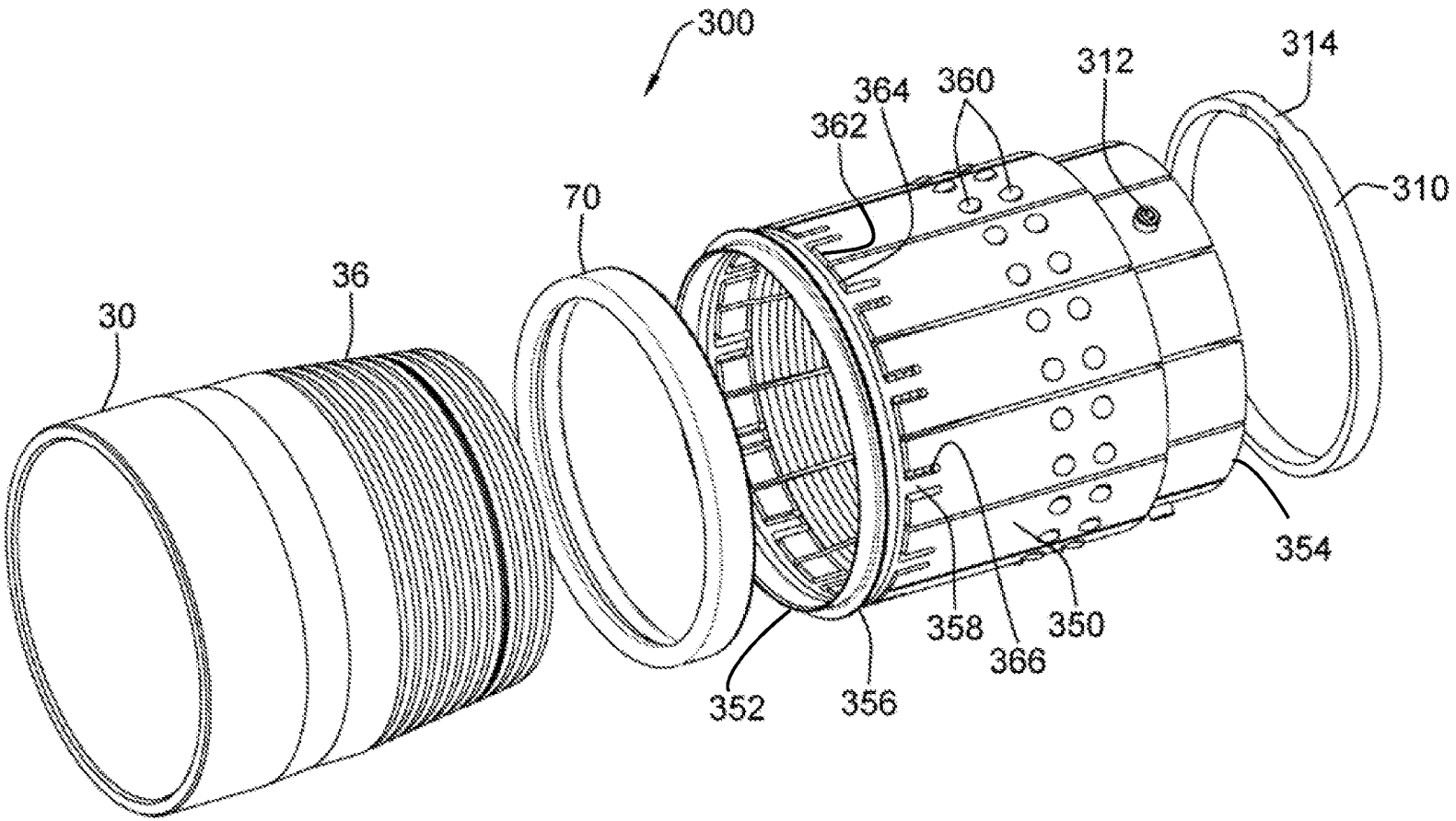
FIG. 14 is an exploded perspective view of a further embodiment of a plug for use in the well bore of FIG. 1.
Figure 15:
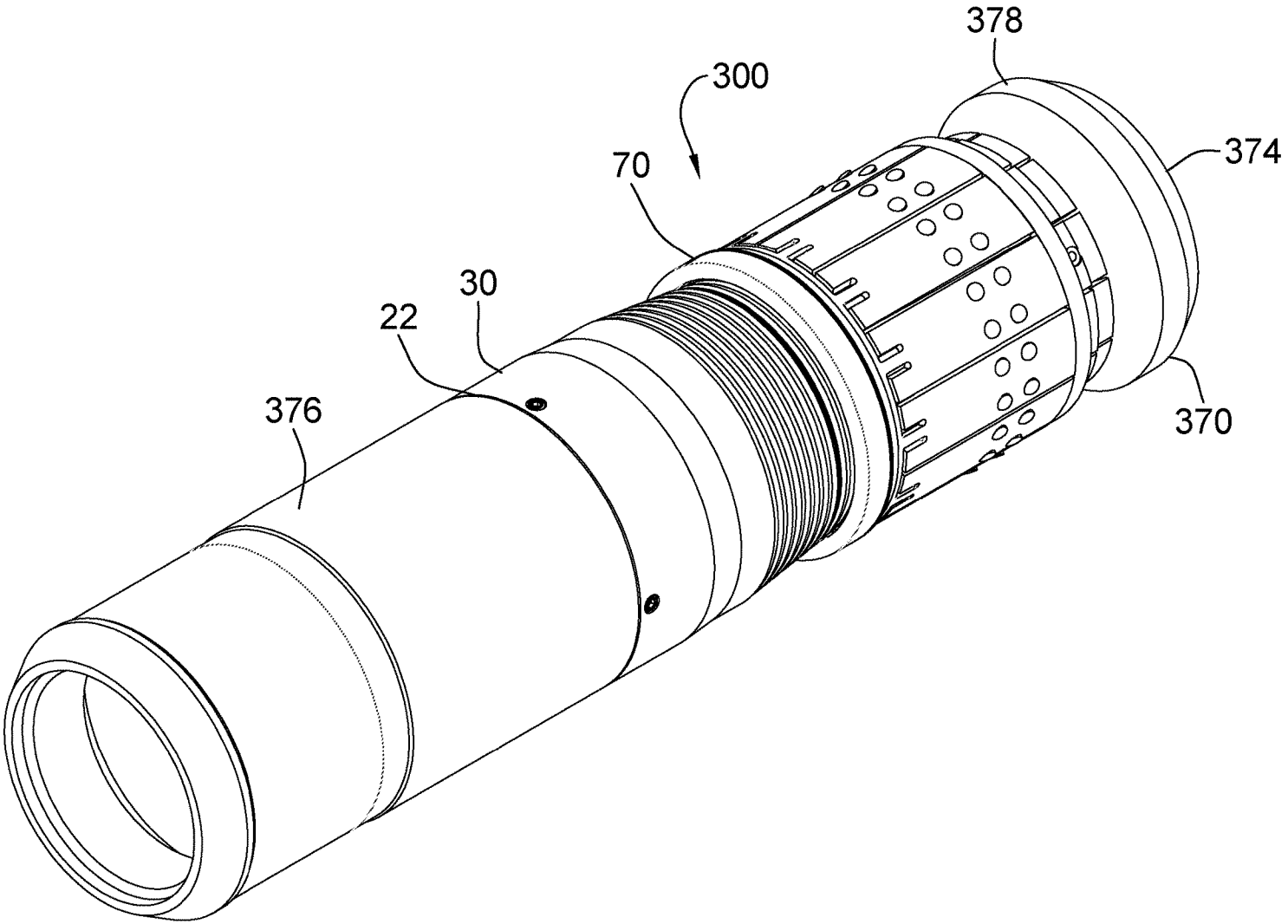
FIG. 15 is a perspective view of the plug of FIG. 14 with a check valve and setting tool located therein.
Figure 16:
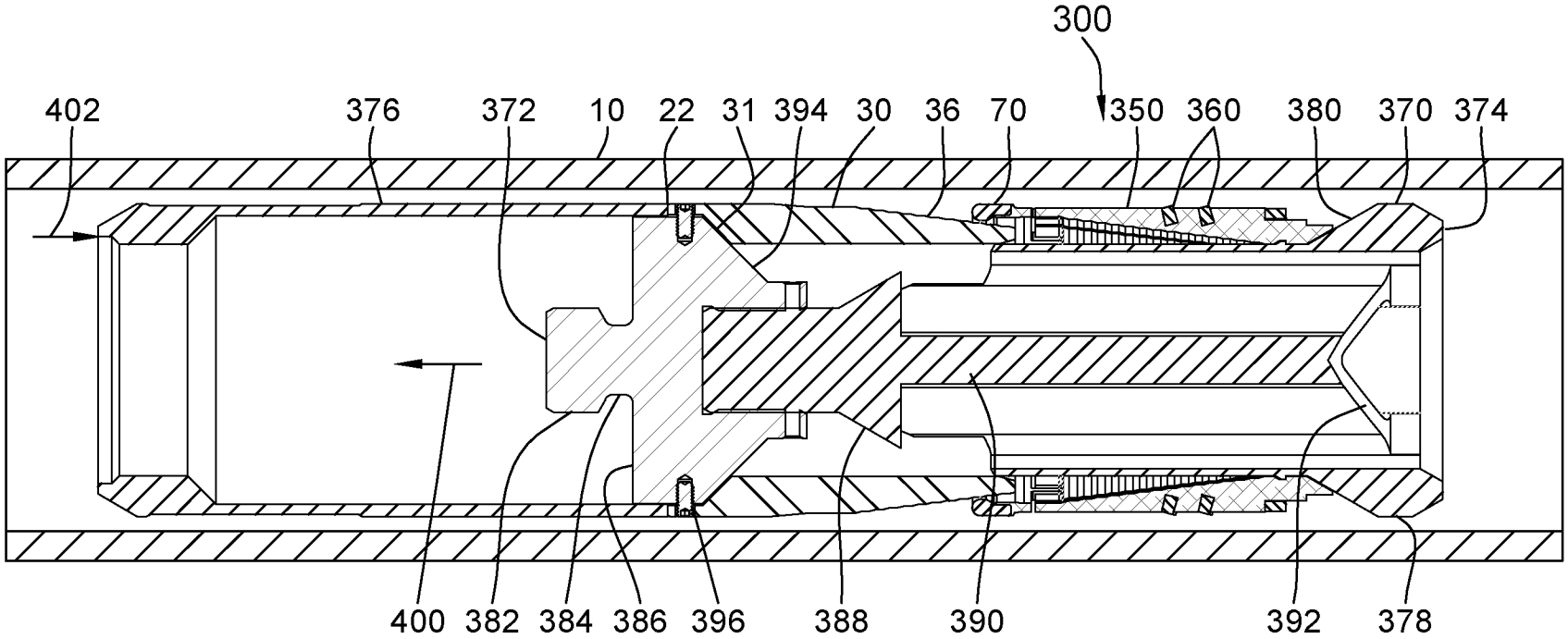
FIG. 16 is a cross sectional view of the plug and check valve of FIG. 15 within a well at a first or run in position.

Turning now to FIG. 14, an alternate embodiment of the present invention is illustrated generally at 300. The alternate fracing plug seat 300 is formed in a similar manner as described above but also includes a retaining ring 310 surrounding the slip arms 350 proximate to a second end 354 thereof, maintained in place around the slip arms 350 with at least one retaining screw 312. The retaining ring 310 includes a frangible narrow portion 314 so as to permit the retaining ring 310 to expand and fracture as the slip arms 350 are extended as set out above. The slip arms 350 may include a plurality of bore engagement plugs 360 therein extending from the top surface thereof to facilitate engagement upon the well bore 10 wall.

Similar to the first embodiment, the slip arms 350 are secured to a ring 356 at a first end 352 thereof. The slip arms extend from a slip arm first end 362 with a gap 364 between the ring 356 and the slip arm first end 362. Longitudinal slots 366 extend from the gap 364 past the slip arm first end 362 defining narrow slip arm connections 358 therebetween. In operation, as the slip arms 350 are extended when force is applied to the second end 354, the slip arm first end 362 pushes up on towards the ring 356, collapsing the gap 358 thereby aiding the ring 356 to push the seal 70 up the cone section 36. The narrow slip arm connections 358 deform as they move up the cone section 36.

Figure 10:
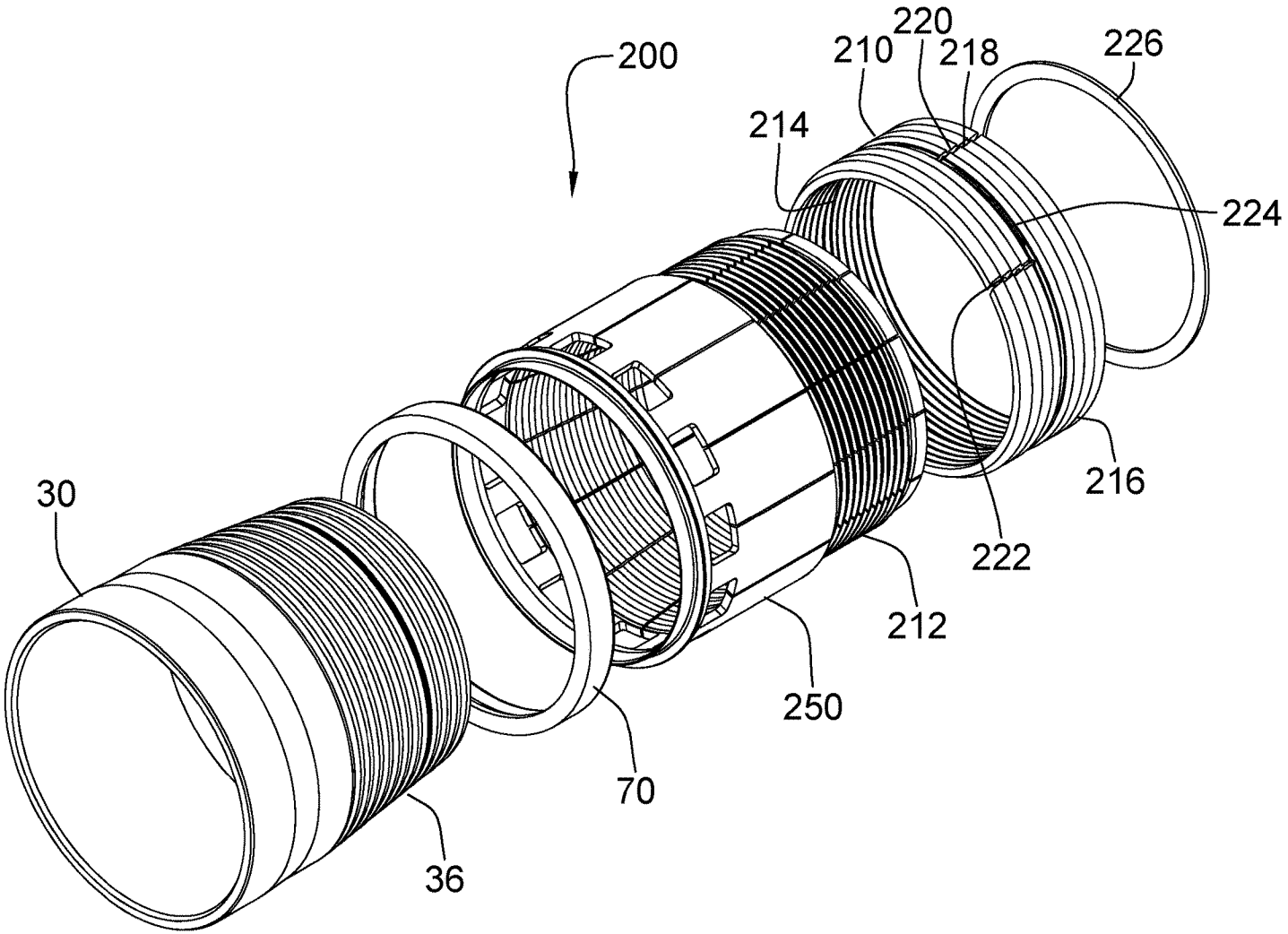
FIG. 10 is an exploded view perspective view of a plug for use in the well bore of FIG. 1.

Turning now to FIGS. 10 through 13, an alternative embodiment of the present invention is illustrated generally at 200. The alternative fracing plug seat 200 is formed in a similar manner but also includes a slip engagement ring 210 surrounding the slip arms 250. As illustrated in FIG. 10, the slip arms 250 may include external threading 212 therearound adapted to engage with corresponding internal threading 214 on the slip engagement ring 210. The slip engagement ring 210 also includes external ridges therearound to facilitate engagement upon the well bore 10 wall. The slip engagement ring 210 includes a split 218 or gap therearound so as to permit the slip engagement ring 210 to expand as the slip arms 250 are extended as set out above. As illustrated, the slip engagement ring 210 includes first and second longitudinal slots 220 and 222, respectively with an annular slot 224 extending therebetween. The first and second longitudinal slots 220 and 222 are separated by a distance selected to be larger than the increased diameter of the slip engagement ring when expanded by the slip arms 250 so as to provide a continuous outer surface at such position. The first and second longitudinal slots 220 and 222 may also be connected by a frangible portion or tab (not shown) extending thereacross so as to prevent expansion of the slip engagement ring until a sufficiently large enough force is applied thereto by the slip arms 250. As illustrated in FIG. 10 a retaining ring 226 may also be provided to retain the slip engagement ring 210 upon the slip arms 250.

Figure 11:
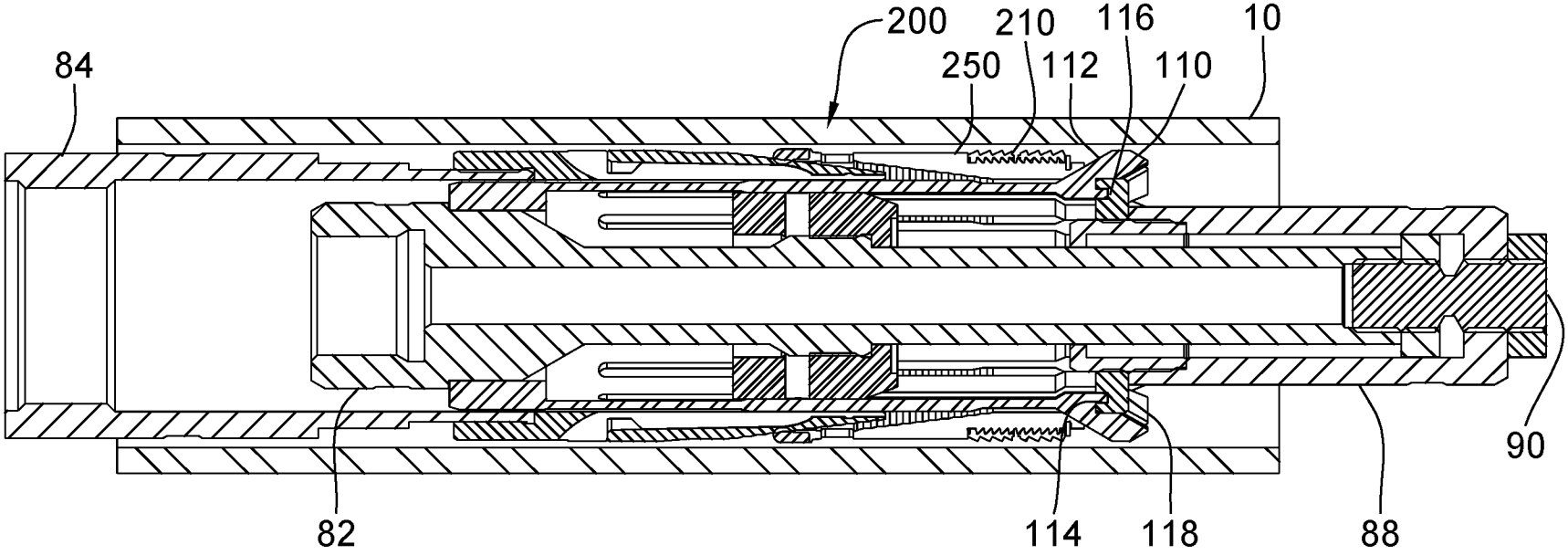
FIG. 11 is a cross sectional view of the plug of FIG. 10 and its associated setting tool at a first or run in position.
Figure 12:
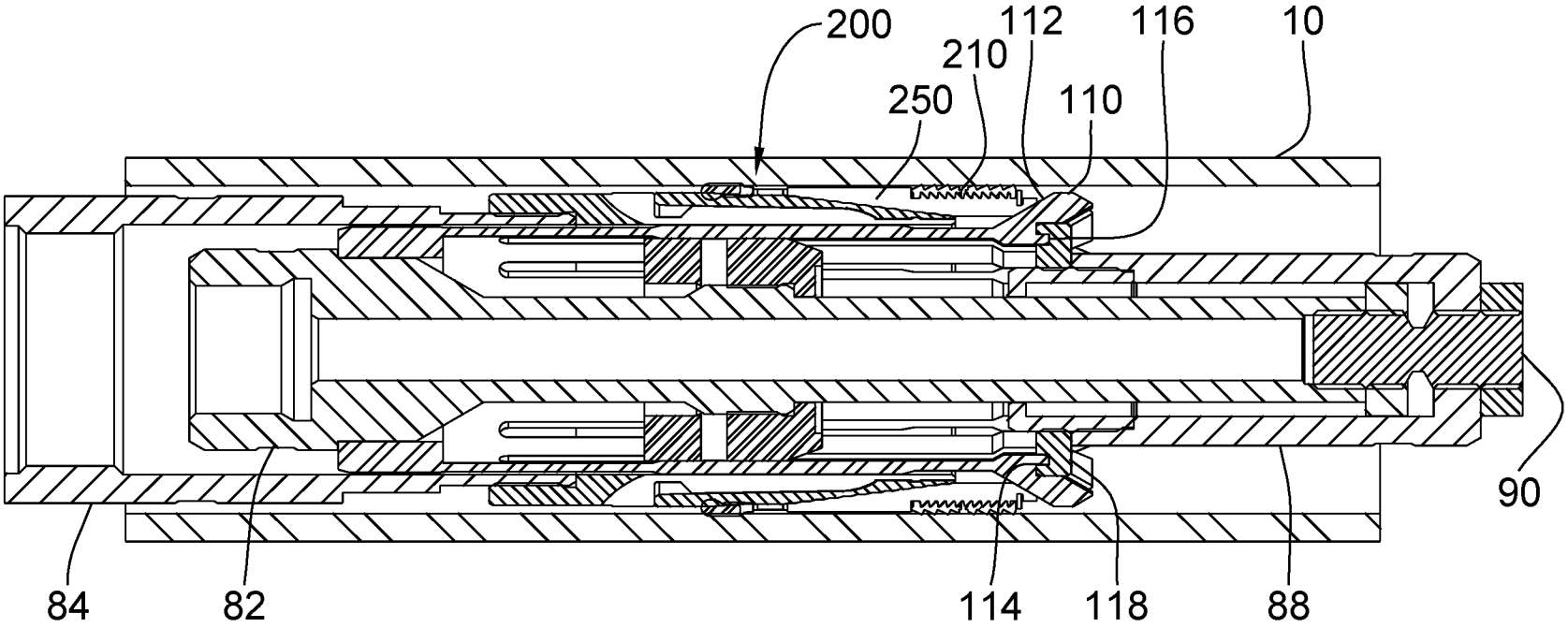
FIG. 12 is a cross sectional view of the plug of FIG. 10 and its associated setting tool at a second or setting position.
Figure 13:
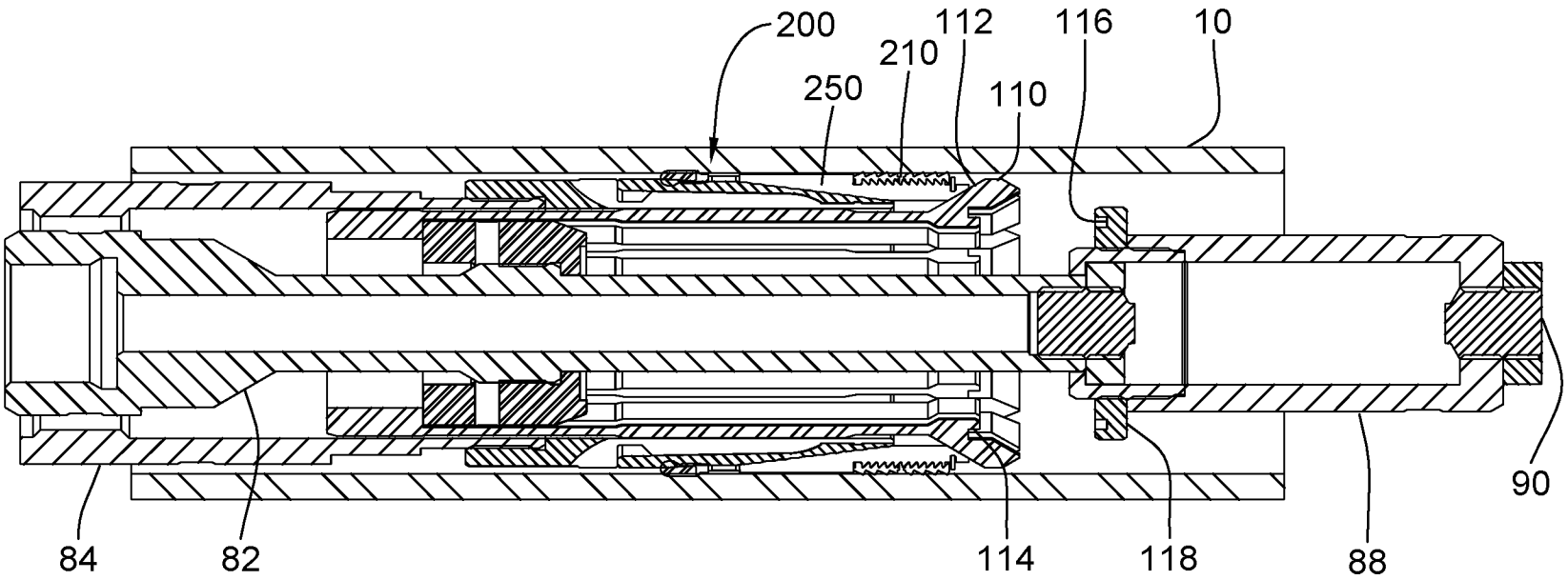
FIG. 13 is a cross sectional view of the plug of FIG. 10 and its associated setting tool at a third or release position.

With reference to FIGS. 11 through 13, the setting tool pull arms 110 may include an annular lip 114 extending therefrom which is positioned and shaped to engage a corresponding annular groove 116 on an annular extension 118 of the transfer sleeve 88. As illustrated in FIGS. 11 and 12, the annular groove 116 may receive the annular lip 114 therein wherein the annular extension 118 engages under the setting tool pull arms 110. In such position, the setting tool pull arms 110 are prevented from radially compressing or expanding as set out above to be useful to extend the slip arms 250 while permitting the setting tool pull arms 110 to retract after disengaging therefrom as set out above.

Referring to FIGS. 15 through 19, a fracing plug seat 300 is illustrated with a check valve 370 therein. The check valve 370 extends between first and second ends, 372 and 374, respectively. A check valve setting tool 376 is adapted to engage upon the first end 22 of the retaining body 30 with the first end 372 of the check valve 370 therein. The second end 374 of the check valve 370 includes a bottom engagement cone portion 378, with an inclined surface 380 in an orientation such that upward movement of the bottom engagement cone portion 378 will bias the slip arms 350 in an outward direction, similar to the inclined surface 112 of the setting tool pull arms 110 as described above. The check valve 370 may be formed of any suitable material, as is commonly known, such as, by way of non-limiting example, steel, aluminum, composite or dissolvable materials.

Figure 17:
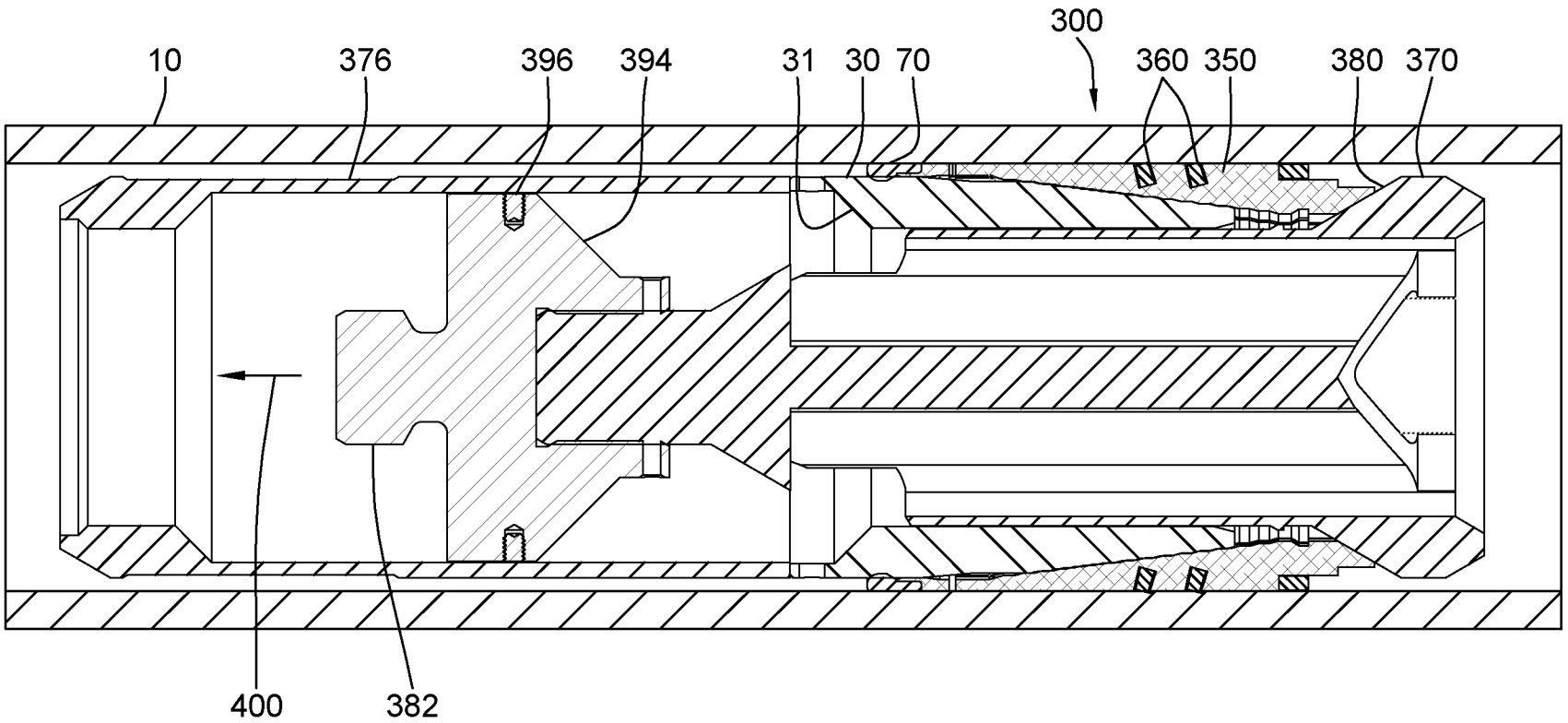
FIG. 17 is a cross sectional view of the plug and check valve of FIG. 15 within a well at a second or engaged position.
Figure 18:
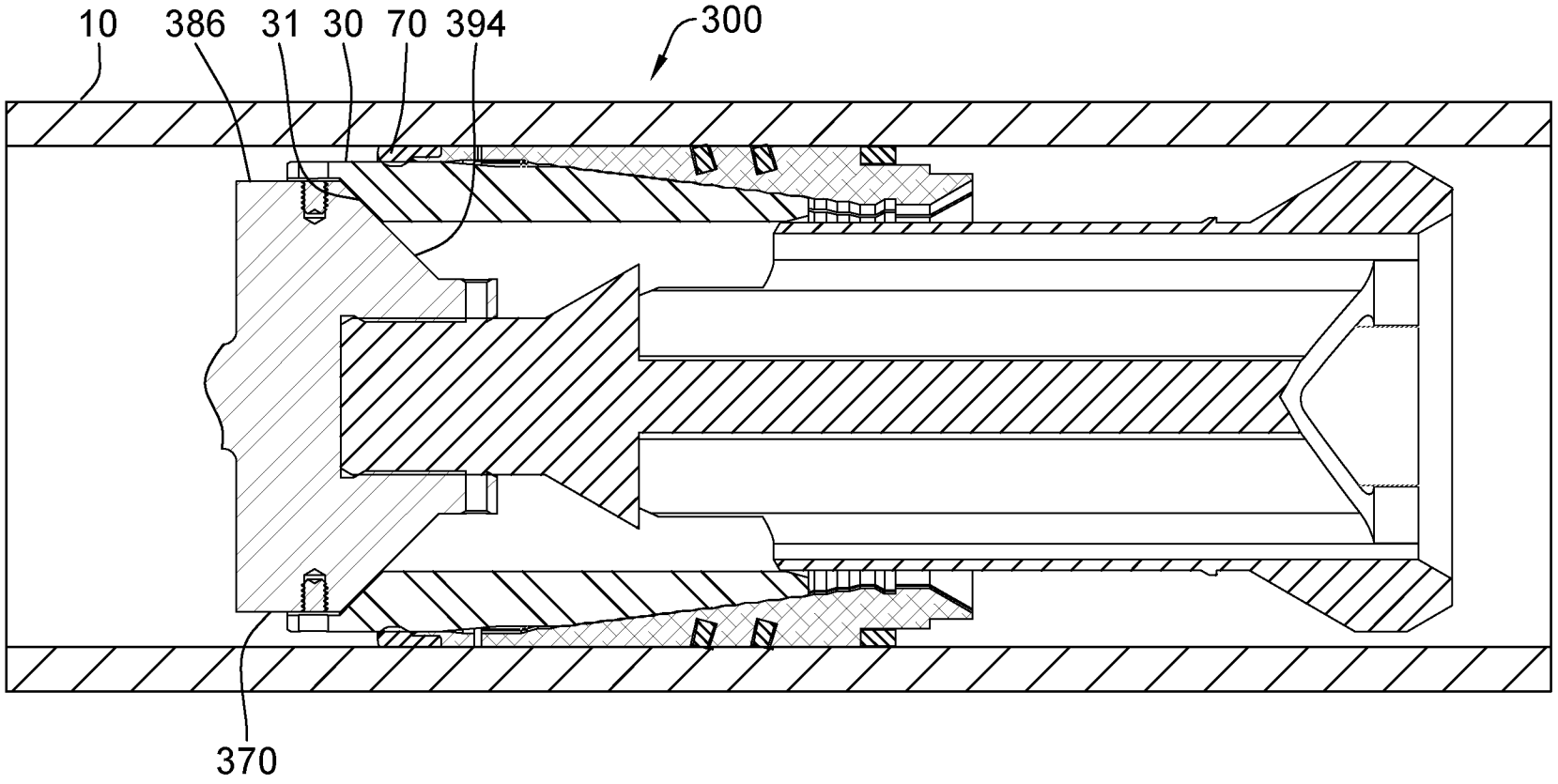
FIG. 18 is a cross sectional view of the plug and check valve of FIG. 15 within a well at a third or fracing position.
Figure 19:
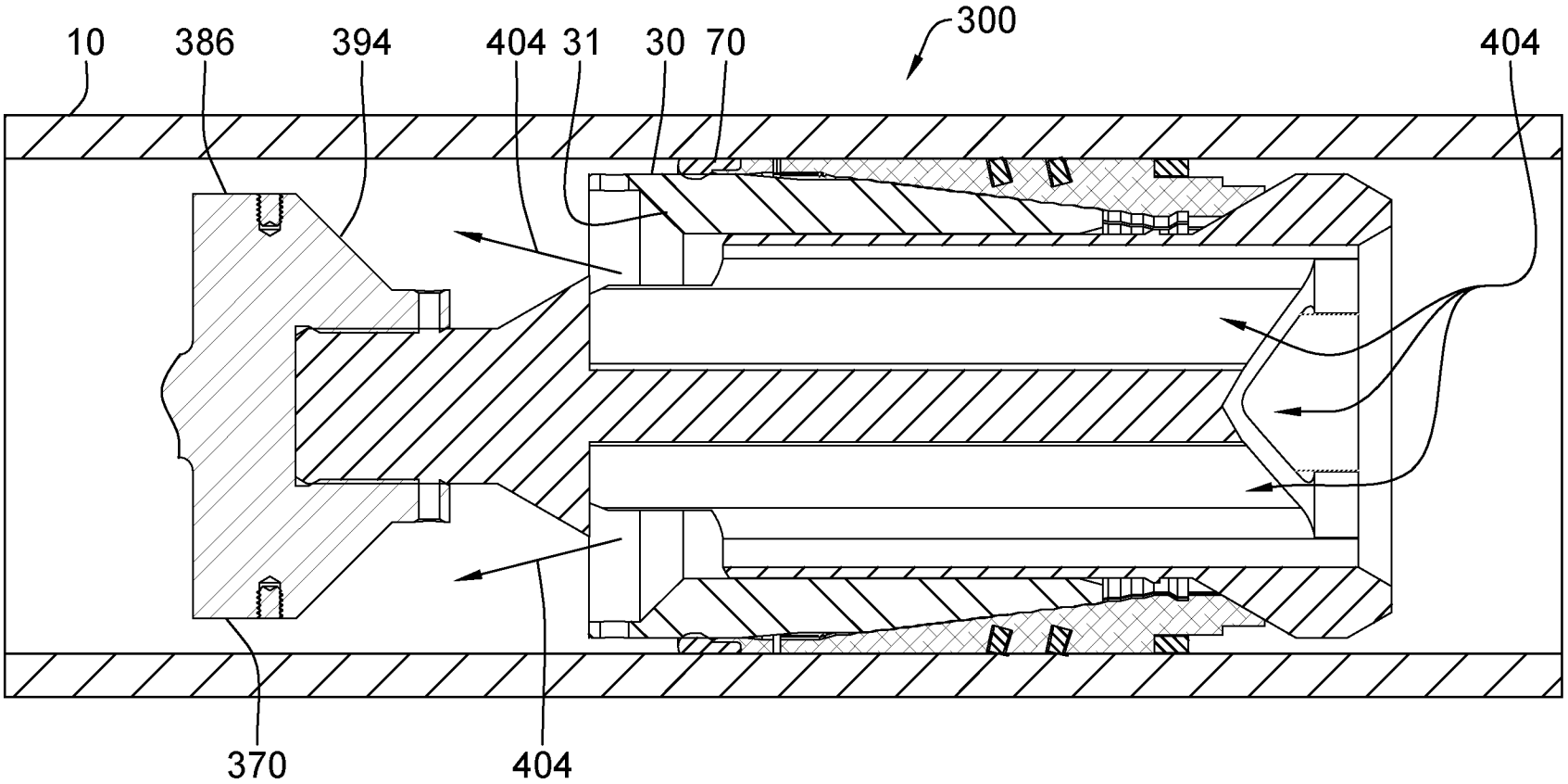
FIG. 19 is a cross sectional view of the plug and check valve of FIG. 15 within a well at a fourth or installed flowing position.

With reference to FIGS. 16 through 19, the check valve 370 includes a frangible protrusion 382 at the first end 372 joined to a top sealing cone portion 386 with a neck portion 384 therebetween. An inner plug portion 388 extends from the top sealing cone portion 386 and includes a central connecting body 390 with a plurality of radial extending arms 392 joining the central connecting body 390 with the tubular inside surface of the bottom engagement cone portion 378, centering the check valve 370 within the fracing plug seat 300 and forming a divided passage 404 therethrough, as illustrated in FIG. 19.

In this embodiment, the retaining body 30 includes an inclined inner surface 31 adapted to engage with an inclined bottom surface 394 of the top sealing cone portion 386, forming a seal therebetween.

In operation, the fracing plug seat 300 is secured to the check valve 370 with set pins 396. The assembly is run into the well bore 10 in the position shown in FIG. 16 with the slip arms 350 retracted and the seal 70 around the cone section 36 above the slip arms 350. Once located at the desired position, the check valve 370 is drawn upwards in a direction generally indicated at 400, while a force is applied to the check valve setting tool 376 in a direction generally indicated at 402, shearing the set pins 396 as the check valve 370 moves upward within the check valve setting tool 376. Continued movement of the check valve 370 engages the inclined surface 380 upon the slip arms 350 thereby pressing the seal 70 up the cone section 36 to be between the retaining body 30 and the well bore 10, as illustrated in FIG. 17, and engaging the slip arms 350 upon the well bore 10.

Further movement in the direction indicated at 400, as illustrated in FIG. 17, fractures the neck portion 384, removing the frangible protrusion 382 from the check valve 370. At such point, the frangible protrusion 382 and check valve setting tool 376 may be removed from the well bore 10, by methods as are commonly known in the art. FIGS. 18 and 19 illustrate the check valve 370 with fracing plug seat 300 installed in a well bore 10 following removal of the frangible protrusion 382 and check valve setting tool 376.

In production, the check valve 370 installed with the fracing plug seat 300 allows for flow from the production zone 6 through the well bore 10, freely lifting the check valve 370 as illustrated in FIG. 19, with production flow passing through the check valve 370 through the divided passage 404 and around the top sealing cone portion 386. As illustrated in FIG. 18, when fracing, fluid pressure is applied into the well bore 10, thereby forcing the top sealing cone portion 386 down such that the inclined bottom surface 394 of the top sealing cone portion 386 engages upon the inclined inner surface 31 of the retaining body 30, sealing off the lower sections of the well bore 10.

While specific embodiments of the invention have been described and illustrated, such embodiments should be considered illustrative of the invention only and not as limiting the invention as construed in accordance with the accompanying claims.

What is claimed is:

1. An apparatus for use in forming a plug during hydraulic fracturing of a subterranean soil formation comprising:

a top tubular retaining body extending between top and bottom ends and having a frustoconical outer surface extending from said bottom end thereof and a plurality of slip arms located around said outer surface of said retaining body, each slip arm extending between top and bottom ends and having an inner surface extending from said slip arm top end corresponding to said outer surface of said retaining body and an exterior surface adapted to engage a wellbore; and a seal element located around said outer surface of said retaining body above said plurality of slip arms adapted to be displaced towards said top end of said retaining body by said plurality of slip arms so as to seal an annulus between said retaining body and said wellbore, wherein said plurality of slip arms extend from a ring surrounding said retaining body adjacent to said seal element.

2. The apparatus of claim 1 wherein said retaining body includes a central bore therethrough.

3. The apparatus of claim 2 wherein said central bore forms a ball seat adapted to retain a ball thereon.

4. The apparatus of claim 2 wherein said central bore includes a slidably movable plug therethrough.

5. The apparatus of claim 4 wherein said slidably movable plug engages upon said plurality of slip arms to draw said plurality of slip arms onto said outer surface of said retaining body.

6. The apparatus of claim 5 wherein said slidably movable plug includes a bottom expanded portion having a larger diameter than said plurality of slip arms.

7. The apparatus of claim 4 wherein said slidably movable plug includes a top plug adapted to be spaced apart from a seat in said retaining body as said plurality of slip arms are drawn over said retaining body.

8. The apparatus of claim 7 wherein said slidably movable plug is operable to slidably shift up and down so as to seal and unseal said top plug against said seat so as to permit fluid flow up said wellbore and prevent fluid flow therepast down said wellbore.

9. The apparatus of claim 1 wherein said plurality of slip arms include tabs extending from said bottom end thereof in a direction substantially parallel to a central axis of said retaining body.

10. The apparatus of claim 9 wherein said tabs include bores adapted to pass a fastener therethrough for securing to a setting tool within said retaining body.

11. The apparatus of claim 10 further comprising a selectably expandable ring surrounding said plurality of slip arms so as to retain said plurality of slip arms at a retracted position until expanded by said setting tool.

12. The apparatus of claim 11 wherein said selectably expandable ring includes a gap therethrough so as to permit radial expansion of said selectably expandable ring.

13. The apparatus of claim 11 wherein said selectably expandable ring includes a frangible portion so as to permit radial expansion of said selectably expandable ring.

14. The apparatus of claim 11 wherein said selectably expandable ring includes a narrowed portion so as to permit radial expansion of said selectably expandable ring after breaking said narrowed portion.

15. The apparatus of claim 10 wherein said setting tool comprises an exterior portion adapted to bear upon a top edge of said retaining body and an interior portion adapted to engage upon a bottom edge of said plurality of slip arms so as to draw said plurality of slip arms towards said retaining body.

16. The apparatus of claim 15 wherein said interior portion includes pull arms adapted to engage said bottom edge of said plurality of slip arms.

17. The apparatus of claim 16 wherein said pull arms include an inclined surface adapted to engage a corresponding inclined surface of said plurality of slip arms.

18. The apparatus of claim 17 wherein said pull arms are longitudinally cantilevered parallel to said axis of said retaining body.

19. The apparatus of claim 18 wherein said interior portion of said setting tool includes a transfer sleeve therearound having a portion adapted to engage upon distal ends of said pull arms to retain said pull arms at a radially expanded position so as to engage upon said plurality of slip arms.

20. The apparatus of claim 19 wherein said transfer sleeve is secured to said interior portion with a frangible connector wherein after said frangible connector is broken, said transfer sleeve is operable to be shifted downward thereby permitting said pull arms to be moved radially inward so as to permit removal of said setting tool.

21. The apparatus of claim 1 wherein said plurality of slip arms are formed of a selectably dissolvable material.

22. The apparatus of claim 1 wherein said plurality of slip arms are formed of a material selected from the group consisting of steel and aluminum alloys.

23. The apparatus of claim 1 wherein said plurality of slip arms include wellbore engaging plugs imbedded therein.

24. An apparatus for use in forming a plug during hydraulic fracturing of a subterranean soil formation comprising:

a top tubular retaining body extending between top and bottom ends and having a frustoconical outer surface extending from said bottom end thereof and a plurality of slip arms located around said outer surface of said retaining body, each slip arm extending between top and bottom ends and having an inner surface extending from said slip arm top end corresponding to said outer surface of said retaining body and an exterior surface adapted to engage a wellbore; and a seal element located around said outer surface of said retaining body above said plurality of slip arms adapted to be displaced towards said top end of said retaining body by said plurality of slip arms so as to seal an annulus between said retaining body and said wellbore, wherein said outer surface of said retaining body is formed of a plurality of alternating angled and horizontal sections.

25. The apparatus of claim 24 wherein said inner surface of said plurality of slip arms includes a plurality of alternating angled and horizontal sections adapted to correspond to said outer surface of said retaining body.

* * * * *